US007134549B2

(12) United States Patent
Salvatori

(10) Patent No.: US 7,134,549 B2
(45) Date of Patent: Nov. 14, 2006

(54) METHOD AND APPARATUS FOR PACKAGING A PROJECTION DEVICE

(75) Inventor: Phillip H. Salvatori, Salem, OR (US)

(73) Assignee: InFocus Corporation, Wilsonville, OR (US)

( * ) Notice: Subject to any disclaimer, the term of this patent is extended or adjusted under 35 U.S.C. 154(b) by 172 days.

(21) Appl. No.: 10/444,447

(22) Filed: May 22, 2003

(65) Prior Publication Data

US 2004/0232019 A1 Nov. 25, 2004

(51) Int. Cl.
*B65D 85/00* (2006.01)

(52) U.S. Cl. ..... 206/320; 206/459.1; 206/592

(58) Field of Classification Search ..... 206/216, 206/223, 320, 521–523, 525, 527, 576, 459.1, 206/459.5, 722, 723, 725, 591–594
See application file for complete search history.

(56) References Cited

U.S. PATENT DOCUMENTS

| | | | | |
|---|---|---|---|---|
| 2,348,620 | A | 5/1944 | Grover | |
| 3,804,238 | A * | 4/1974 | Howard | 206/459.5 |
| 3,926,308 | A * | 12/1975 | Sullivan | 206/723 |
| 4,602,715 | A | 7/1986 | Sarver et al. | |
| 4,696,400 | A | 9/1987 | Warman | |
| 4,790,431 | A | 12/1988 | Reel et al. | |
| 4,837,590 | A | 6/1989 | Sprague | |
| 4,896,776 | A | 1/1990 | Kabanuk et al. | |
| 5,163,560 | A | 11/1992 | Parrish, Jr. et al. | |
| 5,214,574 | A | 5/1993 | Chang | |
| 5,242,056 | A | 9/1993 | Zia et al. | |
| 5,285,559 | A * | 2/1994 | Thompson et al. | 206/523 |
| 5,289,919 | A * | 3/1994 | Fischer | 206/459.5 |
| 5,366,080 | A * | 11/1994 | Carstersen et al. | 206/723 |
| 5,437,367 | A | 8/1995 | Martin | |
| 5,647,484 | A | 7/1997 | Fleming | |
| 5,667,072 | A | 9/1997 | Chang | |
| 5,833,057 | A * | 11/1998 | Char et al. | 206/521 |
| 6,134,105 | A | 10/2000 | Lueker | |
| 6,283,299 | B1 | 9/2001 | Lee | |
| 6,362,954 | B1 | 3/2002 | LeVander | |
| 6,405,873 | B1 | 6/2002 | Koike | |
| 2004/0094448 | A1 * | 5/2004 | Koike | 206/521 |

* cited by examiner

*Primary Examiner*—Luan K. Bui
(74) *Attorney, Agent, or Firm*—Alleman Hall McCoy Russell & Tuttle LLP

(57) ABSTRACT

The present invention provides a protective structure for shipping a projection device. The protective structure includes a carrying case, an impact resistant intermediary case, and a substantially rigid outer case. The carrying case may include a plurality of compartments including a first compartment adapted to receive a projection device and a second compartment adapted to receive an accessory for a projection device. At least one of the compartments may be associated with a unique identifier. The unique identifier also may be associated with a projection device accessory and further may be associated with an attachment point on the projection device.

9 Claims, 3 Drawing Sheets

Fig. 1
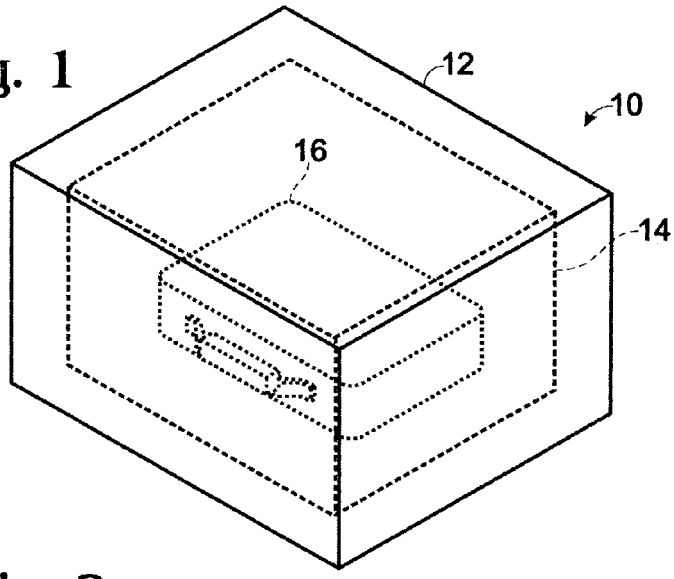
Fig. 2
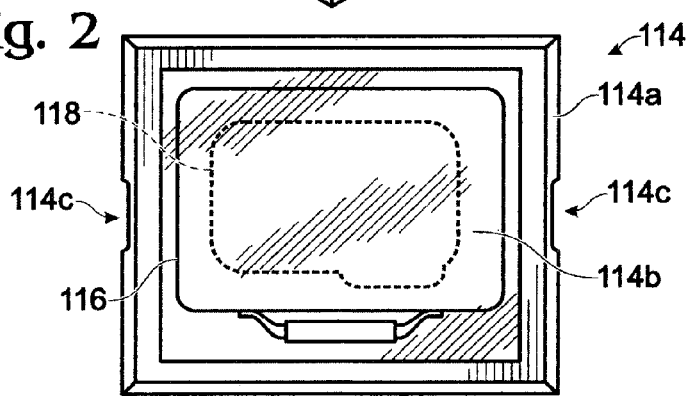
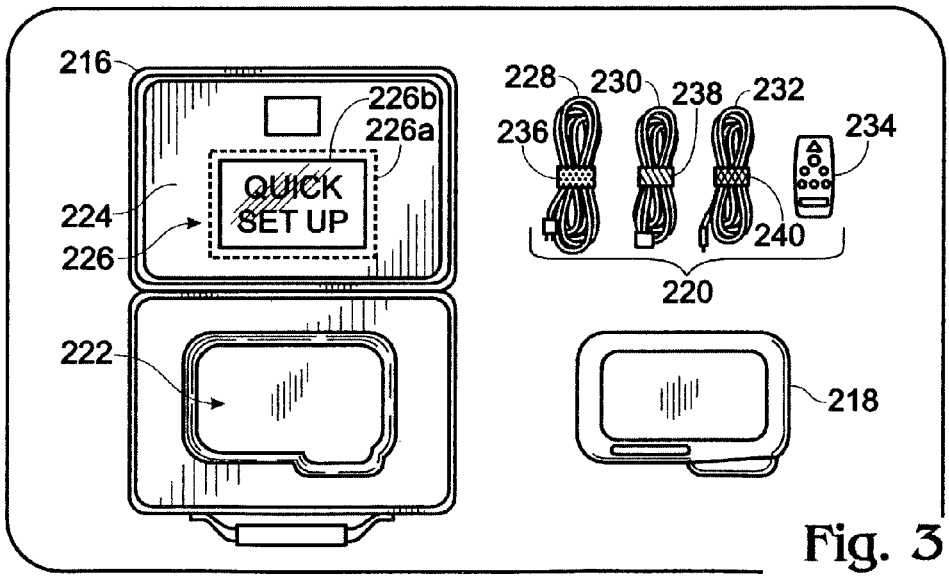
Fig. 3

Fig. 6
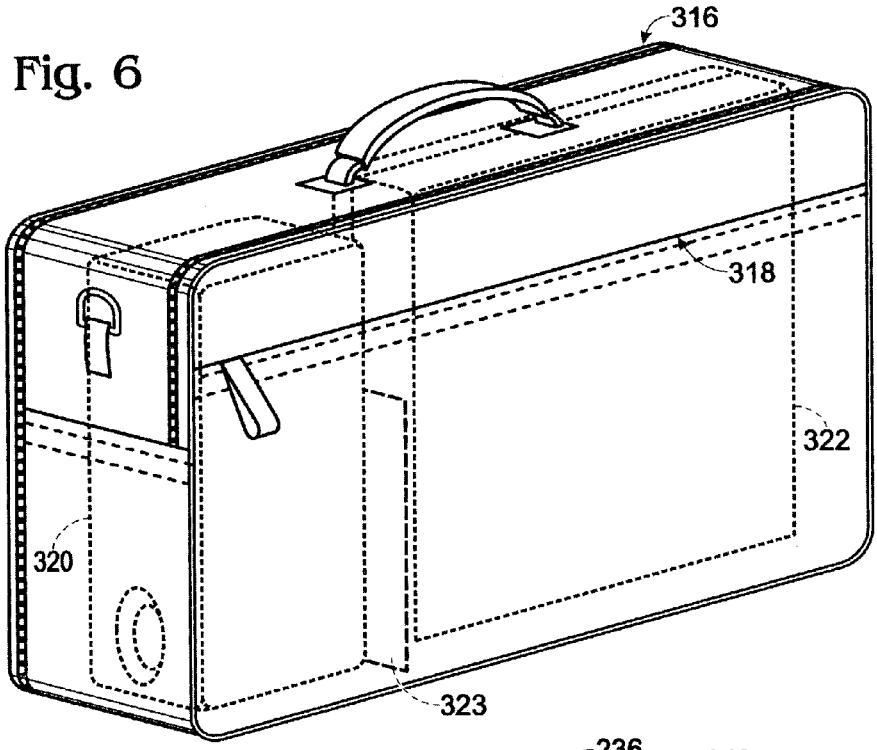
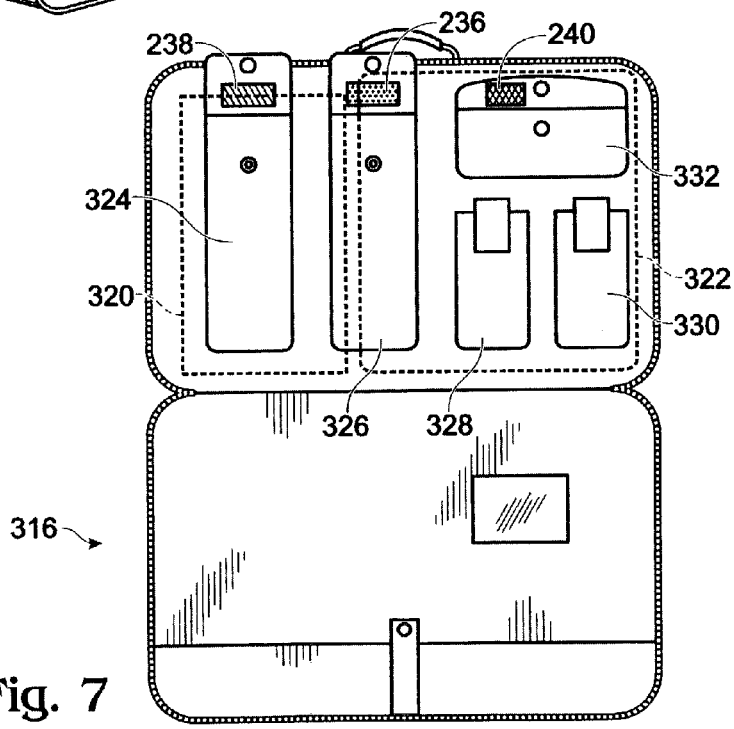
Fig. 7

METHOD AND APPARATUS FOR PACKAGING A PROJECTION DEVICE

TECHNICAL FIELD

The present invention relates generally to packaging electronic and more particularly, to packaging for projection devices.

BACKGROUND

Electronic items are often shipped from place to place. For example, electronic items may be shipped from the manufacturer to a large distribution center, from a large distribution center to a retailer, and from the retailer to the ultimate consumer. It is generally desirable to ship items as compactly as possible in order to minimize shipping costs and storage space.

Once a consumer receives an electronic device, the consumer may continue to transport the electronic device to different locations. Consumers may transport electronic devices via airplanes, trains, cars, or on foot, through crowded streets, and from room to room, providing plenty of opportunities for an electronic device to be bumped, dropped, or potentially damaged in some way. Damage may be of particular concern with electronic devices, such as projection devices, which may be moved from place to place in order to display presentations at a select location.

Thus, there is a need to provide protective carrying cases for projection devices. While a number of protective carrying cases for projection devices are commercially available, these carrying cases are typically shipped separately from the projection device.

In addition, there is a need for a carrying case which easily organizes the projection device and its associated accessories for pre-sale shipment, and post-sale use, such that both the manufacturer and the user can easily identify whether all the associated accessories are included in the carrying case and how those accessories fit together during set-up.

SUMMARY

The present invention provides a protective structure for shipping a projection device. The protective structure includes a carrying case, an impact resistant intermediary case, and a substantially rigid outer case. The carrying case may include a plurality of compartments including a first compartment adapted to receive a projection device and a second compartment adapted to receive an accessory for a projection device. At least one of the compartments may be associated with a unique identifier. The unique identifier also may be associated with a projection device accessory and further may be associated with an attachment point on the projection device.

BRIEF DESCRIPTION OF THE DRAWINGS

FIG. 1 provides an isometric view of a projection device package according to an embodiment of the present invention.

FIG. 2 provides a top view of an inner case encased within an intermediary case according to an embodiment of the present invention.

FIG. 3 is a top view of an opened inner case with a projection device and accessories adapted to be housed within the inner case according to an embodiment of the present invention.

FIG. 6 is a schematic illustration of another inner case.

FIG. 7 is a view of the embodiment shown in FIG. 6 in an open state.

DETAILED DESCRIPTION

Figure 4:
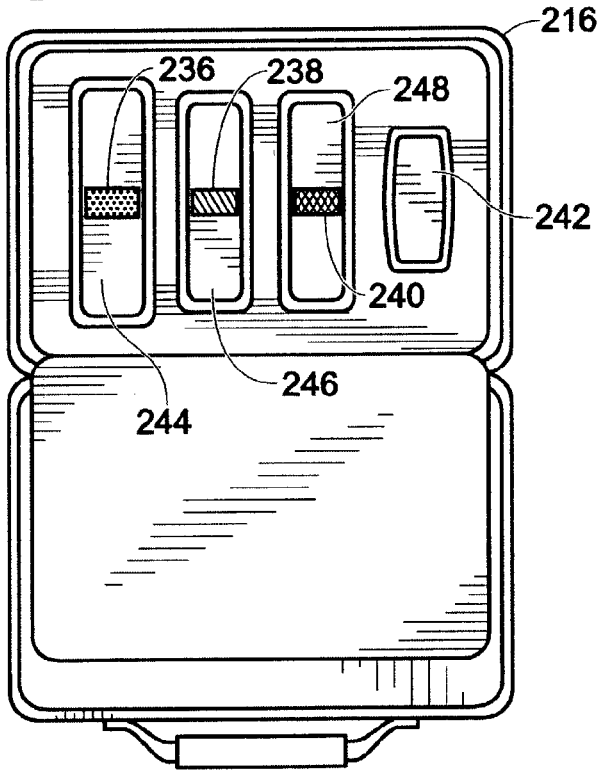
FIG. 4 is a top view of an inner case with the divider opened to reveal compartments adapted to house accessories according to another embodiment of the present invention.

According to one embodiment, the present invention provides a protective structure for packaging and shipping a projection device and methods for doing the same.

A packaging structure according to one embodiment of the present invention is shown generally at 10 in FIG. 1. As shown, packaging structure 10 may include an outer case 12, an intermediary case 14, and an inner or carrying case 16. Outer case 12 may be adapted to receive and retain intermediary case 14. Intermediary case 14 may be adapted to receive and retain inner case 16. Inner may be a dual-purpose case. Specifically, inner case 16 is adapted to received, retain and protect an electronic device, such as a projection device (not shown) during shipping. Such inner case further may be used after purchase as a carrying case for the electronic device, such as a projection device or other suitable electronic device. As used herein, a projection or image-generating device may include any suitable display device or image projector, including, but not limited to, a digital projector, a liquid crystal display (LCD) projector, a digital light processing projector, etc.

If desired, the size of the outer case may substantially correspond to the size of the intermediary case. Furthermore, at least a portion of the intermediary case may substantially correspond to the size of the inner case. Likewise, a portion of the inner case may substantially correspond to the size of the projection device. Put another way, any of the outer, intermediary, or inner cases may include or contain structure adapted to substantially conform to the outer dimensions of at least a portion of the contents within the respective case. For example, intermediary case 14 may include or contain structure adapted to substantially conform to the outer dimensions of inner case 16.

Outer case 12 may be entirely or partially formed of a substantially rigid material. Moreover, the substantially rigid material may be disposable and/or recyclable, such as cardboard or the like. Outer case 12 may have a closable opening, through which intermediary case 14 may be accessible. In some configurations, intermediary case 14 may be adapted to slide in and out of outer case 12 in a drawer-like fashion. Outer case 12 may further include a plurality of flaps adapted to fold over and seal the opening, as with a standard shipping box. It will be appreciated that alternative or additional configurations including cases having openings at the top, bottom, or sides are contemplated by the present invention.

Intermediary case 14 may be entirely or partially formed of a substantially rigid material, such as cardboard or the like. In some cases, it may be desirable for intermediary case 14 to provide a degree of impact resistance to structure 10.

FIG. 2 depicts a top-view of an exemplary intermediary case 114 enclosing an inner case 116. As shown, inner case 116 may be adapted to receive and retain a projection device 118.

Intermediary case 114 may include a substantially rigid outer perimeter 114*a*, formed, for example, out of recyclable cardboard. Extending inwards from the outer perimeter and molded around inner case 116 is an impact resistant material 114*b* such as polyurethane film. In some cases, some or all of the impact resistant material may be transparent so as to reveal at least a portion of inner case 116. Suitable intermediary cases include those sold under the trademark Korvuu® suspension packaging available from Sealed Air Corporation (East Saddle Brook, N.J.). Moreover, intermediary case 114 may include gripping regions 114*c*, which allow a user to grasp the intermediary case when the intermediary case is housed within an outer case. Gripping regions 114*c* may be desirable, for example, when intermediary case 114 is intended to slide in and out of the outer case in a drawer-like fashion.

FIG. 3 depicts an exemplary inner case 216 opened to reveal the internal structure. Inner case 216 may be a hard case formed of plastic, metal, or another rigid material. Alternatively, inner case 216 may be a soft case formed of nylon, leather or another malleable material. Typically, inner case 216 will include some type of impact-resistant structure adapted to protect the inner contents from the type of damage that might be incurred during normal use. For example, inner case 216 may include foam, rubber, Styrofoam or other padded or cushioning material. Moreover, inner case 216 may include a combination of rigid and malleable materials. Typically, inner case 216 is adapted to receive a projection device 218 and a plurality of accessories 220. Inner case 216 may be configured to enable a user (consumer) to transport a projection device and the related accessories to selected locations.

As shown, inner case 216 includes a projection device compartment 222, which is adapted to receive projection device 218. Projection device compartment 222 may be contoured to match the external contours of projection device 218, such that the projection device may fit snugly inside the projection device compartment.

Inner case 216 may further include a removable or movable divider 224. Divider 224 may be adapted to maintain separation between the projection device compartment on one side of inner case 216 and any compartments on the other side of the case.

Divider 224 may include a display area 226. Display area 226 may include a transparent pocket or window 226*a* into which an instruction sheet 226*b* may be placed for easy reference. In some embodiments, the window may extend through the divider such that an aperture is formed in the divider such that the instruction sheet may be seen from either side of the divider. Alternatively, in other embodiments, the window may be only on a single side of the divider, such that the instruction sheet may be seen only on a single side of the divider. As an example, instruction sheet 226*b* may be adapted to provide the user with instructions regarding the set-up procedures for projection device 218. Instruction sheet may further include information regarding the type of projection device, operation, of the projection device, ownership of the projection device, and contact information for help in operating the projection device, etc.

As described above, inner case 216 may be adapted to receive both a projection device and projection device accessories. As non-limiting examples, projection device accessories 220 may include a power cord 228, a computer cable 230, a video cable 232, and a remote control 234. It will be appreciated that inner case 216 need not be adapted to receive the number of accessories shown, but instead may receive more or less than the number of accessories shown. Moreover, inner case 216 may be adapted to receive alternative or additional accessories not depicted in the figures.

Some or all of the projection device accessories may each be associated with a unique identifier. The unique identifier may be a color, a design, a number, an icon, a picture, or the like. For example, power cord 228 may be associated with a first color, computer cable 230 with a second color, and video cable 232 with a third color. The unique identifiers may be incorporated into the accessory itself, i.e., in the example above, if the identifier for the power cord is the color red, the power cord itself may be colored red. Alternatively, or additionally, the unique identifiers may be incorporated into labels attached to the accessories or otherwise associated with the accessory in an identifiable manner. In the embodiment shown in FIG. 3, it can be seen that power cord 228 includes unique identifier 236, computer cable 230 includes unique identifier 238, and video cable 232 includes unique identifier 240.

FIG. 4 depicts inner case 216 with divider 224 positioned to reveal accessory compartments 242, 244, 246, and 248. It will be appreciated that inner case 216 may include more or less accessory compartments, as desired. In some cases, each accessory compartment may be adapted to receive a specific accessory. As such, some or all of the accessory compartments may be shaped to match the external contours of their respective accessories. For example, accessory compartment 242 may be shaped to snugly receive remote control 234.

Alternatively, or additionally, some or all of the accessory compartments may include or display the unique identifier associated with their respective accessories. Thus, accessory compartment 244 may display unique identifier 236, indicating that accessory compartment 244 is adapted to receive power cord 228, while accessory compartment 246 may display unique identifier 238, indicating that accessory compartment 246 is adapted to receive computer cable 230, and accessory compartment 248 may display unique identifier 240, indicating accessory compartment 248 is adapted to receive video cable 232.

Figure 5:
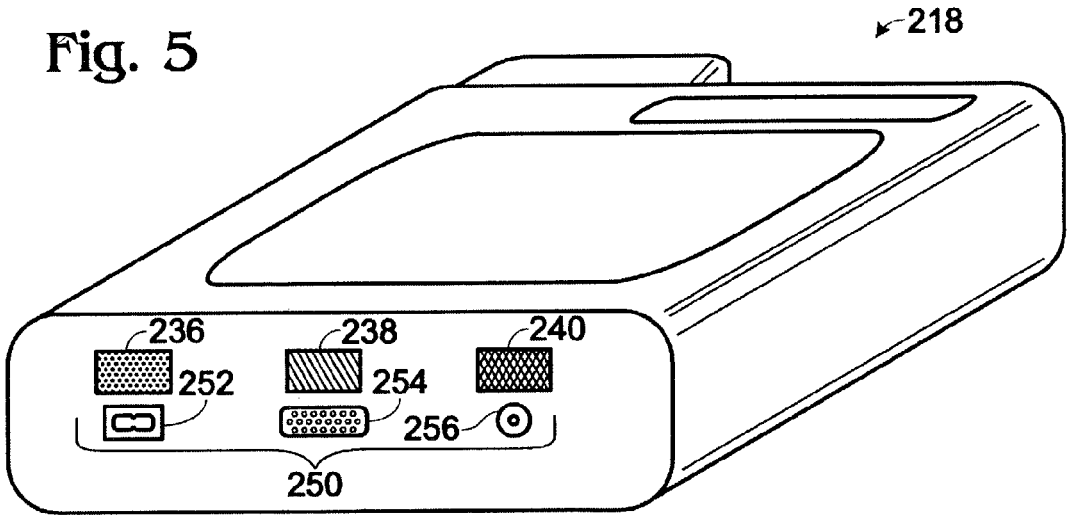
FIG. 5 is a rear view of a projection device suitable for use with the package of the present invention.

FIG. 5 is a rear view of a projection device 218. Projection device 218 may be an image-generating device. As stated above, a projection or image-generating device may include any suitable display device or image projector, including, but not limited to, a digital projector, a liquid crystal display (LCD) projector, a digital light processing projector, etc.

As shown, projection device 218 may include a plurality of attachment points 250. Each of the attachment points may be associated with an accessory. For example, attachment point 252 may be adapted to mate with power cord 228, attachment point 254 may be adapted to mate with computer cable 230, and attachment point 256 may be adapted to mate with video cable 232. As such, each of the attachment points may further include or otherwise be associated with the unique identifiers for their respective accessories. Thus, as shown, unique identifier 236 is displayed above attachment point 252, unique identifier 238 is displayed above attachment point 254, and unique identifier 240 is displayed above attachment point 256. Of course, it will be appreciated that the unique identifiers may be located in any position, so as to indicate association with the appropriate attachment point, and that no particular placement is required by the present invention.

FIG. 6 is a view of another exemplary inner case or carrying case 316. It should be appreciated that inner case 316 may be a soft case, such as a leather case or nylon. In other embodiments, inner case 316 may be a hard, rigid case. Carrying case 316 may include a plurality of pockets or compartments. For example, carrying case 316 may include a front pocket 318, with compartments for writing instruments, business cards, cell phones, and/or personal computers, such as personal data assistants. Further, carrying case 316 may include a carrying handle as shown in FIGS. 1–3, 4, 6 and 7.

Carrying case 316 may be adapted to receive both a projection device 320 and a personal computer, such as a laptop computer 322. For example, carrying case 316 may include a first compartment (or projection device compartment) adapted to receive a projection device 320, and a second compartment (computer compartment) adapted to receive a laptop computer 322. The first compartment may be adjacent to the second compartment. A flexible partition 323 may divide the two compartments. Both compartments may be contoured to match the external contours of the devices, such that the devices fit snugly inside their respective compartments. Depending on the size of the projection device, such a configuration may enable the size of carrying case to be reduced to the size of a standard briefcase. It should be appreciated that other layouts are possible without departing from the scope of the invention.

FIG. 7 depicts exemplary carrying case 316 opened to reveal a portion of the internal structure of the case. In addition to being adapted to receive projection device 320 and computer 322, carrying case 316 is further adapted to receive a plurality of accessories. Thus, in a single carrying case, a user (consumer) may transport a projection device, a computer and the related accessories.

In some embodiments, a divider may separate the projection device compartment and the computer compartment from the accessory compartments. The divider may be a permanent divider or a removable divider.

As described above, carrying case 316 may be configured to receive projection device accessories, such as, but not limited to, power cords, computer cables, video cables, remote controls, etc. Some or all of the projection device accessories may be associated with unique identifiers, such as colors, designs, numbers, icons, pictures, text, or the like. For example, the power cord may be associated with a first color, the computer cable with a second color, and the video cable with a third color. Thus, as shown in FIG. 3, power cord 228 may include a unique identifier 236, computer cable 230 may include a unique identifier 238, and video cable 232 may include a unique identifier 240.

Carrying case 316, shown in FIG. 7, includes multiple accessory compartments, 324, 326, 328, 330 and 332. One or more of these accessory compartments may include or display unique identifiers associated with the respective accessories. Thus, for exemplary purposes only, accessory compartment 324 may display unique identifier 238, indicating that accessory compartment 324 is adapted to receive computer cable 230 (shown in FIG. 3). Similarly, accessory compartment 326 may include unique identifier 236, indicating that accessory compartment 326 is adapted to receive power cord 228. Likewise, accessory compartment 332 may include unique identifier 240, indicating accessory compartment 332 is adapted to receive video cable 232. In some embodiments, accessory compartment 328 and 330 may also be identified with a unique code that matches other accessories, such as a remote control. Each of the identifiers may be integrated within the compartments, such as on the closure flaps of the compartments. However, although the identifiers are shown on carrying case 316 as located under the closure flaps of the compartments, it should be appreciated that the unique identifiers may be permanently attached or selectively removable from any portion of the compartments.

As illustrated and discussed in relation to FIG. 5, a projection device may include a plurality of attachment points 250. Each of the unique identifiers displayed on the accessories and accessory compartments of carrying bag 316 may correspond to such attachment points on a projection device or computer. Such correspondence between the unique identifiers on the accessories and on the projection device and/or computer, may simplify the set-up of the projection device. Moreover, the use of such identifiers may enable a user to organize and store the accessories in an easy-to-use manner. The use of the identifiers further may enable a user to quickly identify if any accessories are missing.

It should be appreciated that carrying case 316 may include additional compartments, which may or may not be labeled. For example, carrying case 316 may include compartments for a computer mouse, computer discs, users manuals, papers, files, etc.

The disclosure set forth above encompasses multiple distinct inventions with independent utility. Although each of these inventions has been disclosed in its preferred form(s), the specific embodiments thereof as disclosed and illustrated herein are not to be considered in a limiting sense, because numerous variations are possible. The subject matter of the inventions includes all novel and nonobvious combinations and subcombinations of the various elements, features, functions, and/or properties disclosed herein.

The following claims particularly point out certain combinations and subcombinations regarded as novel and nonobvious and directed to one of the inventions. These claims may refer to "an" element or "a first" element or the equivalent thereof; such claims should be understood to include incorporation of one or more such elements, neither requiring nor excluding two or more such elements. Inventions embodied in other combinations and subcombinations of features, functions, elements, and/or properties may be claimed through amendment of the present claims or through presentation of new claims in this or a related application. Such claims, whether directed to a different invention or to the same invention, and whether broader, narrower, equal, or different in scope to the original claims, also are regarded as included within the subject matter of the inventions of the present disclosure.

What is claimed is:

1. A protective structure for shipping a projection device, the protective structure comprising:

a reusable carrying case having a carrying handle comprising:

a plurality of compartments wherein at least one of the compartments is associated with a unique identifier, the unique identifier corresponding to an attachment point on the projection device, the plurality of compartments including:

a projection device compartment adapted to receive the projection device;

an accessory compartment adapted to receive an accessory;

an impact resistant intermediary case adapted to receive the carrying case; and a substantially rigid outer case adapted to receive the intermediary case.

2. The protective structure of claim 1, wherein the unique identifier is a color.

3. The protective structure of claim 1, wherein the unique identifier is an icon.

4. The protective structure of claim 1, wherein the carrying case further comprises a moveable divider separating the projection device compartment from the accessory compartment.

5. The protective structure of claim 1, wherein the accessory compartment is associated with a first Identifier and is adapted to receive a first accessory having a matching identifier.

6. The protective structure of claim 1, wherein a first accessory is adapted to mate with a first attachment point on the projection device, the first attachment point having an identifier that corresponds with the first accessory.

7. The protective structure of claim 1, wherein at least a portion of the intermediary case is transparent, and where the transparent material portion of the intermediary case reveals at least a portion of the carrying case.

8. A protective structure for shipping a projection device, the protective structure comprising:

a carrying case comprising:

a plurality of compartments wherein at least one of the compartments is associated with a unique identifier, the plurality of compartments including:

a projection device compartment adapted to receive the projection device;

an accessory compartment adapted to receive an accessory;

an impact resistant intermediary case'adapted to receive the carrying case;

a divider separating the projection device compartment from the accessory compartment wherein the divider includes a transparent pocket enclosing an instruction sheet; and a substantially rigid outer case adapted to receive the intermediary case.

9. The protective structure of claim 8, wherein the instruction sheet is viewable upon opening the carrying case.

* * * * *